US006095506A

United States Patent [19]

Schmalz et al.

[11] Patent Number: 6,095,506

[45] Date of Patent: Aug. 1, 2000

[54] VACUUM CLAMPING SYSTEM

[75] Inventors: Kurt Schmalz, Dornstetten; Rolf Stockburger, Glatten, both of Germany

[73] Assignee: J. Schmalz GmbH, Glatten, Germany

[21] Appl. No.: 09/176,903

[22] Filed: Oct. 22, 1998

[30] Foreign Application Priority Data

Oct. 22, 1997 [DE] Germany ..... 197 46 497

[51] Int. Cl.[7] ..... B25B 11/00

[52] U.S. Cl. ..... 269/21

[58] Field of Search ..... 269/21, 20, 329; 279/3; 294/64.1; 451/388

[56] References Cited

U.S. PATENT DOCUMENTS

| | | | |
|---|---|---|---|
| 3,520,055 | 7/1970 | Jannett | 269/21 |
| 5,553,837 | 9/1996 | Kahle | 269/21 |
| 5,562,276 | 10/1996 | Blick | 269/21 |
| 5,722,646 | 3/1998 | Soderberg et al. | 269/329 |
| 5,853,169 | 12/1998 | Hern et al. | 269/21 |
| 5,857,667 | 1/1999 | Lee | 269/21 |
| 5,901,426 | 5/1999 | Okazaki et al. | 269/329 |

FOREIGN PATENT DOCUMENTS

| | | |
|---|---|---|
| 3434329C1 | 4/1986 | Germany . |
| 4221222A1 | 1/1994 | Germany . |
| 4404413C1 | 1/1995 | Germany . |
| 29518188U1 | 2/1996 | Germany . |
| 19613094A1 | 10/1997 | Germany . |

*Primary Examiner*—Robert C. Watson
*Attorney, Agent, or Firm*—Jones, Tullar & Cooper, P.C.

[57] ABSTRACT

In a vacuum clamping system with a support base and a block suction device for clamping a workpiece, the block suction device and the workpiece can be clamped by means of a single vacuum circuit. The block suction device can be placed in arbitrary positions on the support base.

9 Claims, 4 Drawing Sheets

VACUUM CLAMPING SYSTEM

FIELD OF THE INVENTION

The present invention relates to a vacuum clamping system which has a support base and a block suction device which can be placed on a support surface of the support base and on which workpieces to be clamped can be placed. The support surface of the support base is provided with shut-off valves, through which air can be aspirated off and the block suction device and/or the workpiece are clamped. The block suction device has a seal surrounding at least one shut-off valve on its underside resting on the support surface, by means of which a closed space is formed, which can be evacuated by means of the shut-off valve.

BACKGROUND OF THE INVENTION

Spreader bars are known, in particular in connection with woodworking machines, on which block suction devices are placed which are used for clamping the workpiece to be processed, for example wood panels or the like. Following the placement of the block suction devices on the spreader bars, they are fixed by suction on the spreader bars, so that they are fixed in place. This takes place in that one or several shut-off valves provided in a first vacuum circuit are opened, through which a closed space provided on the underside of the block suction device is connected with a first vacuum circuit. Following the placement of the workpiece on the block suction devices, a vacuum is supplied to a second vacuum circuit and by means of this vacuum the workpiece is held by suction by the block suction device. This occurs in that a clamping space has been provided at the top of the block suction device, which is connected via a connecting line passing through the block suction device with the underside of the block suction device and terminates in the space provided there for the purpose of clamping the block suction device against the spreader bar. This connecting line is connected with the second vacuum circuit. For clamping the workpiece, first the block suction device is positioned and then the workpiece is clamped. These clamping systems have the considerable advantage that the block suction devices can be centrally clamped and the workpieces can be centrally fixed by suction via the block suction devices. There is no need for a hose connection with every individual block suction device, which often has an interfering effect. It is therefore possible to release the workpiece without having to release the block suction device.

However, it has also been found that the spreader bars are relatively expensive, since they need to be provided with two vacuum circuits. In addition, the spreader bars must be provided with respectively two shut-off valves at the locations not occupied by the block suction device, so that the two vacuum circuits can be blocked there. Furthermore, the block suction devices can only be linearly displaced on the spreader bars, i.e. in a direction, which corresponds to the longitudinal extension of the spreader bars. In a direction transversely to this it is necessary to displace the spreader bars in relation to each other. If it is intended to process different workpieces one after the other, this can possibly lead to a considerable adjustment outlay. In addition, as a rule the block suction devices cannot be turned.

Also known are jig tables, on which the block suction devices can be arbitrarily placed. This has the advantage that the position of the individual block suction devices can be exactly matched to the shape of the workpiece. In addition, changes in the position of the block suction devices can be simply performed.

However, it is considered a disadvantage in connection with such jig tables that it is necessary to connect the individual block suction devices via hoses with the vacuum sources. But these hoses have an interfering effect on the processing of the workpiece because, for one, they lie next to the block suction devices on the jig table and are covered by the processing waste. In addition, such hoses can be damaged very easily.

SUMMARY OF THE INVENTION

It is therefore an object of the present invention to eliminate the above mentioned disadvantages and/or to make a vacuum clamping system available, which is constructed relatively simply and permits a more flexible manipulation.

In accordance with the present invention this object is attained in that the distance between two shut-off valves, or the distance between their flow cross sections, on the support level of the support base is less than or the same as the distance between two seals, located opposite each other and bordering the shut-off valves, or at least two sealing edges, located opposite each other, of the seals of the block suction device.

It is assured in this way that, when the block suction device is placed on the support base, the space on the underside of the block suction device which is bordered by the seal is seated in every case on a shut-off valve, so that this space can be supplied with a vacuum.

Thus clamping of the workpiece is performed by means of the space used for clamping the block suction device. The attainment of this object in accordance with the present invention has the considerable advantage that merely one single vacuum circuit is required for clamping the block suction device and for clamping the workpiece. Therefore the structure of the support base, for example a spreader bar, also is considerably simpler than that of systems having two vacuum circuits.

Since only one vacuum circuit is needed, only one shut-off valve is needed for the aspirating openings of the support base, so that the number of shut-off valves is halved in comparison with known embodiments. Furthermore, the block suction device of the vacuum system in accordance with the present invention need not be placed on the support base in a defined orientation. With the prior art it is necessary to always place the block suction device in such a way that the one aspirating opening communicates with the space for fixing the block suction device in place by suction, and the other aspirating opening with the connecting line to the clamping space. If the block suction device is set down skewed, if this were possible at all, this can result in malfunctions. But since the block suction device can only be placed in one defined position, or respectively setting, the application options with the known clamping systems are limited. With the clamping system of the present invention, both the block suction device and the workpiece are clamped through one single aspirating opening in the support base. Therefore the block suction device can take up any desired position on the support surface, since the space for clamping the block suction device communicates with one aspirating opening of the support base.

In an advantageous manner, the seal of the block suction device bordering the shut-off valve is wider than the cross section of the flow opening of the shut-off valve. In this way leakages because of shut-off valves which are only partially covered by the block suction device are prevented, something which could lead to malfunctions, i.e. faulty aspiration of the block suction device. If the block suction device is placed on the support base in such a way, that the seal rests on a shut-off valve, the latter is completely blocked. If this shut-off valve is nevertheless activated, i.e. opened, flow-through is prevented by the seal. If the shut-off valve is inside the space and is partially covered by the seal, the space for clamping the block suction device is still dependably provided with a vacuum. But if the shut-off valve partially extends to the exterior and is partially covered by the seal, the shut-off valve is not switched on. Because of the wide seal, however, the space for clamping the block suction device is not connected with the exterior, i.e. the environment, through the shut-off valve.

It is provided in connection with a preferred exemplary embodiment that the underside of the block suction device has a ferromagnetic element in the closed space. In this way the shut-off valves located underneath the ferromagnetic element are already opened because of the placement of the block suction device on the support base. The ferromagnetic element is provided inside the space surrounded by the seal in such a way that all shut-off valves located inside this space are opened.

In accordance with a preferred embodiment, the block suction device is modularly constructed and has exchangeable tops for different sizes of workpieces. This has the considerable advantage that it is not necessary to respectively provide a special block suction device for certain workpieces, for example very narrow workpieces, workpieces with surfaces which are difficult to hold by suction, etc., but instead the block suction device merely needs to be provided with a special top.

Because of this design in accordance with the present invention of the vacuum clamping system, the support base can be a spreader bar or a jig table, wherein the jig table can be constructed of several clamping modules, which can be coupled to each other. Because of this design in accordance with the present invention, the block suction device can be placed at any arbitrary position on the jig table, wherein an exact alignment of the block suction device is not necessary. For example, it is possible by means of suitable machine programming to calculate the required number of block suction devices, and the optimal positions of the block suction devices on the jig table for clamping the workpiece can be determined. These positions can, for example, be indicated on the jig table by means of a laser beam, so that the block suction devices can be positioned there. It is possible in this way for one to hold the workpieces optimally, and furthermore to optimally support them, so that oscillations during processing of the workpieces can be prevented to the greatest possible extent.

Further advantages, characteristics and details of the present invention ensue from the following description, wherein a particularly preferred exemplary embodiment is described in detail, making reference to the drawings. Here the characteristics represented in the drawings and mentioned in the specification and the claims can be important for the present invention respectively by themselves or in any arbitrary combination.

DESCRIPTION OF THE PREFERRED EMBODIMENT

Figure 1:
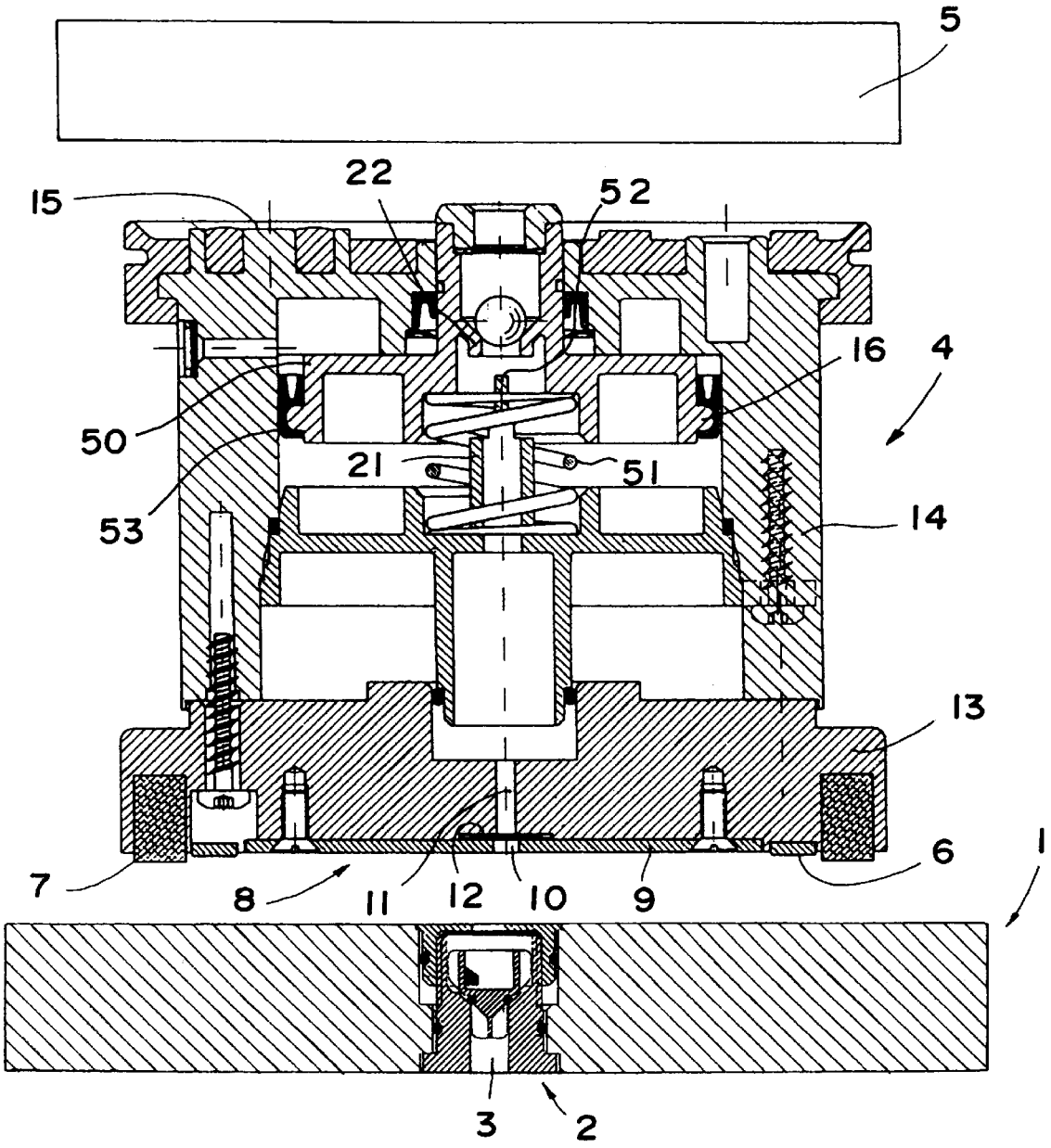
FIG. 1, is a longitudinal section through a block suction device, as well as the support base in accordance with the present invention.

The upper portion of a support base 1 is represented in FIG. 1, wherein a shut-off valve 2 is arranged. A flow conduit 3 is opened, or respectively closed, via this shut-off valve 2, which is in the closed position in FIG. 1. A block suction device 4 is located above the shut-off valve 2, by means of which a workpiece 5, for example a particle board or the like, can be attracted by suction and held in place. On its underside 6, the block suction device 4 has a circumferential seal 7, which defines a space 8. A plate 9 made of a ferromagnetic material, for example a steel plate, has been screwed to the underside 6 of this space 8. This plate 9 has a center opening 10, which is aligned with a flow conduit 11. A screen 12 is located immediately behind the opening 10. The seal 7 and the plate 9 are located on a bottom element 13 of the block suction device 4. A top 14, on whose top surface 15 the workpiece 5 is placed, has been screwed on this bottom element 13.

Figure 2:
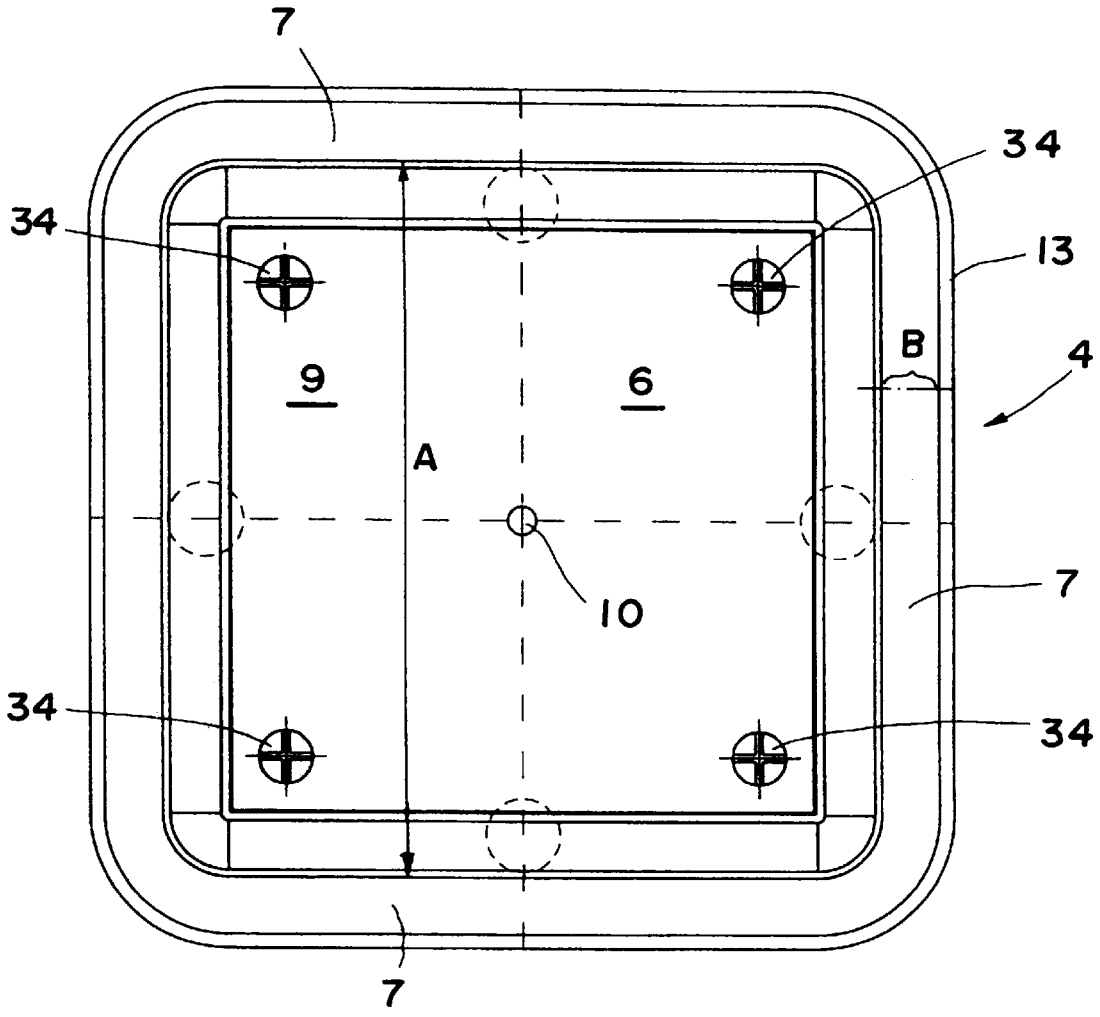
FIG. 2, is a view of the underside of the block suction device of FIG. 1, and FIG. 3, is a top view of a support base embodied as a jig table.

FIG. 2 shows the underside 6 of the bottom element 13 of the block suction device, and in particular the plate 9, which is fastened by means of four screws 34 on the bottom element 13. The central opening 10 is in the center. A seal 7, which has a defined width B., extends around the plate 9.

Figure 3:
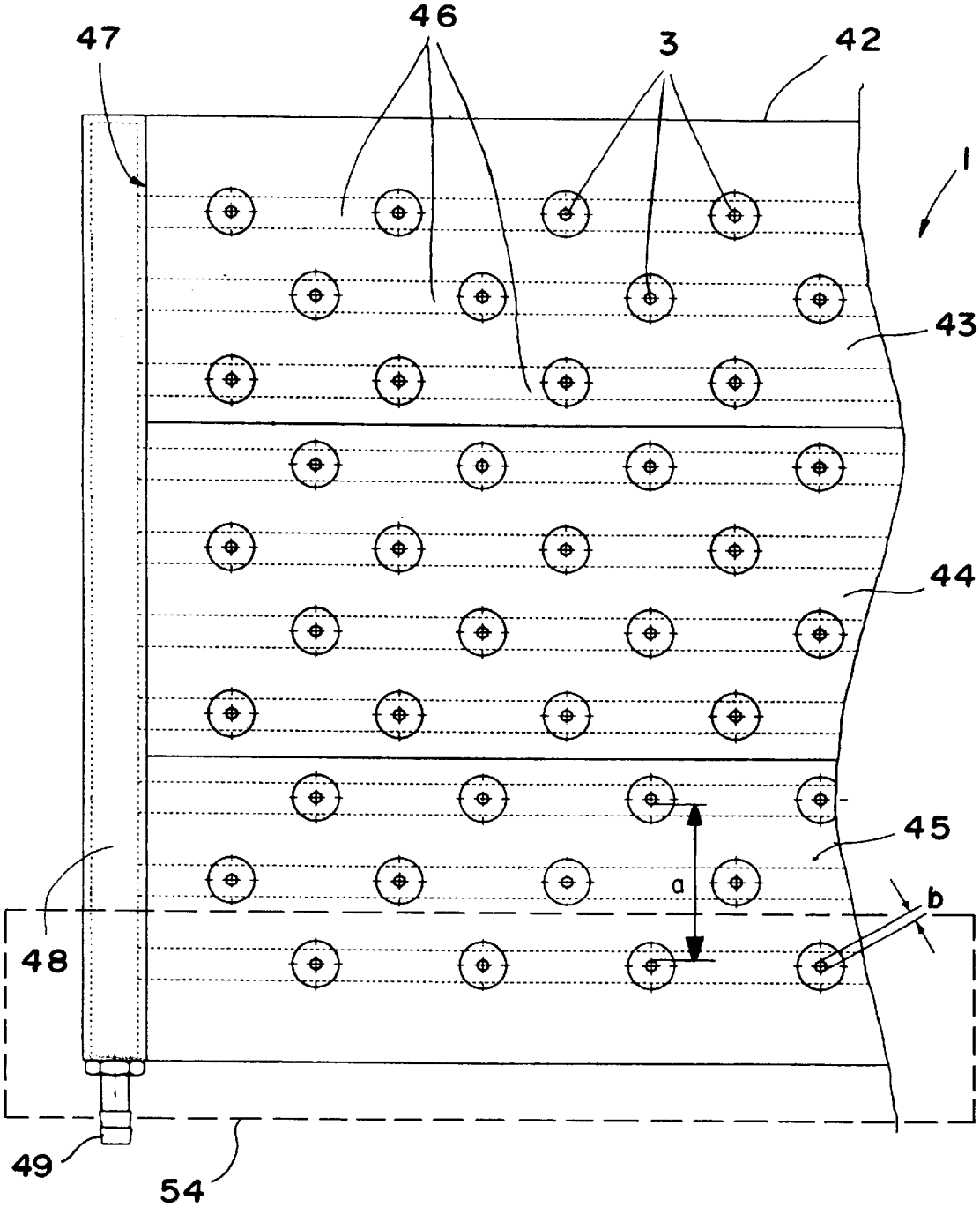

FIG. 3 shows a jig table 42 as the embodiment of the support base 1. In the present exemplary embodiment, this jig table 42 is constructed of three modules 43 to 45, which can be plugged into each other with their longitudinal sides. The modules are provided with flow conduits 46 extending in the longitudinal direction, in which the flow conduits 3 terminate. The front ends 47 of the modules 43 to 45 are connected to a collection manifold module 48, by means of which all flow conduits 46 can be centrally provided with a vacuum. In this way it is possible to construct jig tables 42 of almost any arbitrary size.

In those instances where movement in one direction is all that is necessary, a full jig table, such as table 42, is not needed. Instead, a partial table or what is known as a spreader bar 54 is used. That is, a table comprising only one row of shut-off valves is all that is necessary.

The flow conduits 3 have a width b. Furthermore, the greatest distance a between two neighboring shut-off valves 2 is less than the shortest distance A of seals 7 located opposite each other on the underside of the block suction device 4 (FIG. 2). In this way it is assured that when a block suction device 4 is placed on a jig table 42, the space 8 is located above a shut-off valve 2 in every case, so that it can be supplied with a vacuum every time. A key valve or a flow valve, which can also have a bypass, for example, can also be used as the shut-off valve 2.

Figure 4:
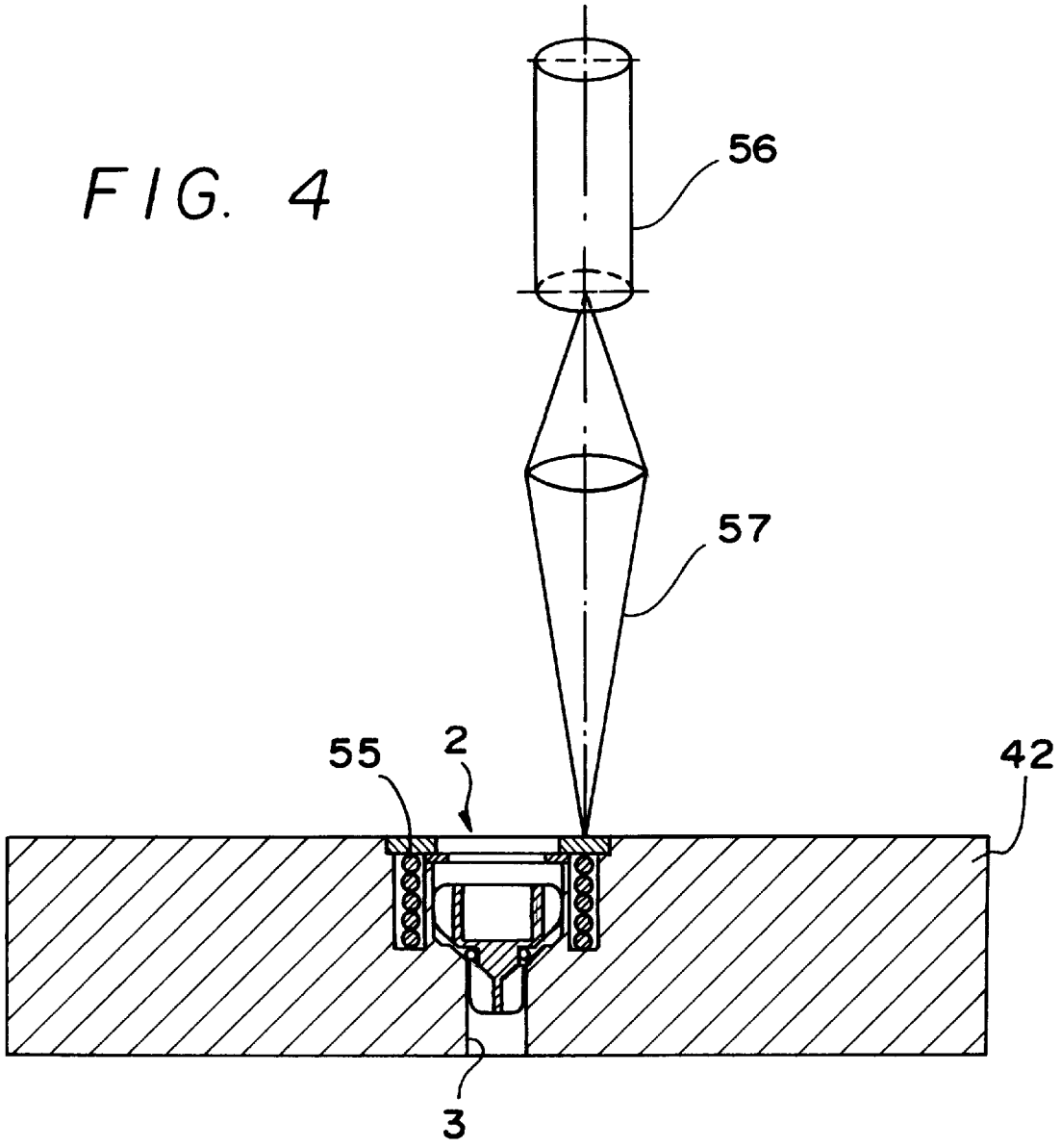
FIG. 4 shows an arrangement including a laser.

FIG. 4 shows the jig table 42 with one or more valves 2 in the form of an electromagnetic valve having an electromagnetic coil 55 together with a laser 56 and a laser beam 57. The laser beam 57 from the laser 56 is used to actuate the coil 55 of the valve 2. The technology for doing this is known and need not be discussed in any greater detail. The laser can be a single laser which is movable to the different valves, or a separate laser can be employed with each valve. In either case, a suitable controller can be employed to control the operation of the laser(s).

As shown in FIGS. 1 and 3, when a vacuum is applied to any of the flow conduits 3 from a vacuum source (not shown) through a connector 49, the manifold 48 and flow conduits 46, the block suction device 4 is held to the support base 1 due to the vacuum being retained in the defined space 8. In addition, the vacuum draws an intermediate part 50 down against the force of spring 51 mounted on shaft extension 21. The shaft extension 21 includes a pin part 52 which engages the ball of the ball valve 22, thereby communicating the vacuum to the top surface 15 for holding the workpiece 5 against the top surface 15. The intermediate part 50 includes a circumferential rib 16 which engages a sliding seal 53 to allow for the movement noted.

When the vacuum is removed at the flow conduit 3 the spring 51 opens the ball valve 22 and causes the workpiece 5 to be released from the top surface 15. In addition, the block suction device 4 can be removed from the support base 1.

What is claimed is:

1. A vacuum clamping system for supporting workpieces, comprising:

a support base defining a support surface, and including at least one air passage having a shut-off valve for controlling the flow of air through said at least one air passage; and at least one block suction device mounted to said support surface and serving to support a workpiece, said at least one block suction device defining an underside with said underside in association with a respective one of said at least one air passages, and including means defining a seal at said underside which surrounds said associated air passage, said seal defining a closed space with said underside in communication with said at least one air passage, wherein the defined seal has oppositely defined sides, and the distance between adjacent ones of said air passages is less than or equal to the distance between oppositely located sides of said associated seals.

2. The vacuum clamping system for supporting workpieces according to claim 1, wherein the width of each of said seals is wider than the flow cross section of its associated flow passage.

3. The vacuum clamping system for supporting workpieces according to claim 2, further comprises:

a ferromagnetic element situated in each closed space against said respective underside.

4. The vacuum clamping system for supporting workpieces according to claim 1, wherein said block suction device is modularly constructed, and includes interchangeable tops for different size workpieces.

5. The vacuum clamping system for supporting workpieces according to claim 1, wherein said support base comprises one of a spreading bar and a jig table said jig table being formed by one or more clamping modules coupled to each other.

6. The vacuum clamping system for supporting workpieces according to claim 1, wherein the position of several block suction devices can be determined by a machine program as a function of the shape of the workpiece.

7. The vacuum clamping system for supporting workpieces according to claim 1, wherein the vacuum supply to a block suction device is provided without hoses.

8. The vacuum clamping system for supporting workpieces according to claim 1, wherein the shut-off valve associated with each of said air passages can be actuated by one of electromagnetism, and a laser beam, and wherein said shut-off valve is one of: a flow valve, and a key valve.

9. The vacuum clamping system for supporting workpieces according to claim 6, further comprising:

a laser, wherein the position of the block suction devices on said support surface can be indicated by said laser.

* * * * *